United States Patent [19]

Eissmann

[11] Patent Number: 4,607,211

[45] Date of Patent: Aug. 19, 1986

[54] METHOD OF CORRECTING INACCURATE INSTRUMENTAL POTENTIAL TRANSFORMER RATIO

[75] Inventor: Kurt W. Eissmann, Dalton, Mass.

[73] Assignee: General Electric Company, King of Prussia, Pa.

[21] Appl. No.: 679,335

[22] Filed: Dec. 7, 1984

[51] Int. Cl.[4] ..... H01F 40/14

[52] U.S. Cl. ..... 323/356; 29/593; 323/359; 324/55; 336/142; 336/150

[58] Field of Search ..... 29/593, 605; 323/356, 323/359; 324/55, 74, 127; 336/142, 143, 145, 146, 150

[56] References Cited

U.S. PATENT DOCUMENTS

| | | | |
|---|---|---|---|
| 1,853,764 | 4/1932 | Fischer | 323/359 |
| 3,098,990 | 7/1963 | Farrand et al. | 29/605 |
| 3,162,799 | 12/1964 | Roberts | 323/356 |
| 3,448,340 | 6/1969 | Lewis . | |
| 3,532,963 | 10/1970 | Marks | 323/359 |
| 3,532,964 | 10/1970 | Marks | 323/359 |
| 3,614,595 | 1/1970 | Paulden | 323/344 |
| 4,160,224 | 7/1979 | Owen | 336/150 |
| 4,255,734 | 3/1981 | Owen | 336/150 |

FOREIGN PATENT DOCUMENTS

| | | | |
|---|---|---|---|
| 482756 | 10/1936 | United Kingdom | 323/344 |
| 652558 | 9/1949 | United Kingdom | 323/344 |

*Primary Examiner*—William H. Beha, Jr.
*Assistant Examiner*—Jeffrey Sterrett
*Attorney, Agent, or Firm*—Robert A. Cahill; William Freedman

[57] ABSTRACT

To compensate for voltage ratio errors in a cascaded core instrument potential transformer, the coils of an outer coupling winding otherwise utilized to magnetically couple an adjacent pair of cores together are electrically connected into the primary winding circuit to either add its turns to or subtract its turns from the primary winding turns in order to bring the secondary winding output voltage within acceptable accuracy tolerance limits.

9 Claims, 3 Drawing Figures

METHOD OF CORRECTING INACCURATE INSTRUMENTAL POTENTIAL TRANSFORMER RATIO

BACKGROUND OF THE INVENTION

The present invention relates to cascaded instrument-type potential transformers for developing a low secondary voltage which is proportional to the high primary voltage and particularly to a method for compensating the transformer voltage ratio so that the magnitude of the secondary voltage reflects the primary voltage within acceptable accuracy tolerance limits over the entire operating voltage range.

Instrument potential transformers are widely used by electrical utilities to develop a low secondary voltage for application to indicating and/or recording equipment so as to provide a measure of the high primary or line voltage. These transformers are also utilized to power lower voltage relays and other control devices, while effectively isolating these devices and instruments from the high primary voltage. In the case of voltage measuring equipment, it is critical, in terms of meeting customer demands and satisfying established industry standards, that the voltage transformation from a high primary voltage to a low secondary voltage have a voltage ratio error tolerance of no more than plus or minum 0.003. That is, errors in the secondary voltage magnitude are manifested in a ratio of primary to secondary voltage which is slightly less or slightly greater than the desired or nameplate ratio as determined by the ratio of primary to secondary winding turns. Out of tolerance voltage ratio error can arise even though stringent quality control checks are made to insure that the correct number of primary turns, which number in the tens and hundreds of thousands for kilovolt ratings of 100 and above, are indeed wound. Typically, the core itself is the major source of ratio error. The problem is aggravated at the high kilovolt ratings in that instrument transformers are typically built with two or even three distinct core stages arranged in well spaced, vertically cascaded fashion. Even slight variations in the core magnetic reluctance and/or losses of the core in each of the various stages will produce inequalities in the voltage drops across the several primary windings and consequent voltage ratio errors. A contributing factor can be unequal stray capacitances between each stage and ground. Since the output or secondary winding is wound about the core of only one stage, usually the one adjacent the low voltage or grounded terminal of the transformer, an inequality in the voltage drop across the primary winding of that stage relative to the voltage drops across the primary winding of the other stage or stages will result in an induced secondary winding voltage which is not precisely equal to its turns ratio relationship to the primary winding circuit.

An unacceptable voltage ratio error can not be identified until the voltage transformer is completely built and fully tested at full and ten percent over full excitation. Preliminary tests at lower excitation voltages typically do not reveal a problem transformer. The conventional remedy to correct voltage ratio errors is disassemble the core or cores and the coils and restack the core laminations and/or rework the cores. Since cascaded potential transformers are encased in a porcelain housing filled with insulating oil and can be up to sixteen feet tall, this voltage ratio correction procedure is a time consuming, expensive operation.

It is accordingly an object of the present invention to improve the voltage ratio accuracy of instrument potential transformers.

A further object is to provide an improved method of correcting for voltage ratio errors in multi-stage, cascaded instrument potential transformers.

An additional object of the present invention is to provide a voltage ratio correction method of the above character which obviates the need for restacking and or reworking the cores of a cascaded instrument potential transformer.

Yet another object of the present invention is to provide a voltage ratio correction method of the above-character which is effective and is efficient and practical in its execution.

Other objects of the invention will in part be obvious and in part appear hereinafter.

SUMMARY OF THE INVENTION

In accordance with the present invention, electrical and magnetic imbalances amongst the stages of a cascaded instrument potential transformer which give rise to unacceptable voltage ratio errors are compensated for in an expeditions and practical manner by simply adding to or subtracting turns from the primary winding. This is achieved without having to wind or unwind coils or turns on or off the transformer cores. Rather the addition or subtraction of effective primary winding turns is achieved through the utilization of core windings already present in a typical cascaded instrument potential transformer design. That is, the adjustment in the effective number of primary winding turns is effected by a simple change in the electrical connections between existing core windings.

More specifically, a cascaded instrument potential transformer of typical design is equipped with one or more so-called outer coupling windings, each having a pair of coils connected in a loop circuit with one coil wound on the core of one stage and the other coil wound on the core of an adjacent stage. The electrical connection between the primary windings of these two stages is normally tied to the outer coupled winding loop circuit associated with the same two stages to maintain the latter at the primary circuit interstage voltage. The normal inclusion of the outer coupling coils is for the purpose of providing a tight, e.g. low impedance, coupling between stages. In accordance with the present invention, if the secondary winding output voltage is too low, the electrical connection between the outer coupling winding and the primary winding circuit is altered such as to subtract the turns of the outer coupling winding coils from the total primary winding turns. On the otherhand, if the secondary winding output voltage is too high, the primary winding circuit-outer coupling winding connection is altered to add the turns of the outer coupling winding coils to the total primary winding turns. In this way correction for voltage ratio errors can be achieved without resorting to disassembly of the transformer stages, removal of the core winding and then restacking and/or reworking the cores.

The present invention will be more fully understood and its several objects and advantages made apparent by reference to the following detailed description taken in conjunction with the accompanying drawings, in which:

DESCRIPTION OF THE DRAWINGS

Corresponding reference numerals refer to like parts throughout the several views of the drawings.

DETAILED DESCRIPTION OF THE INVENTION

Figure 1:
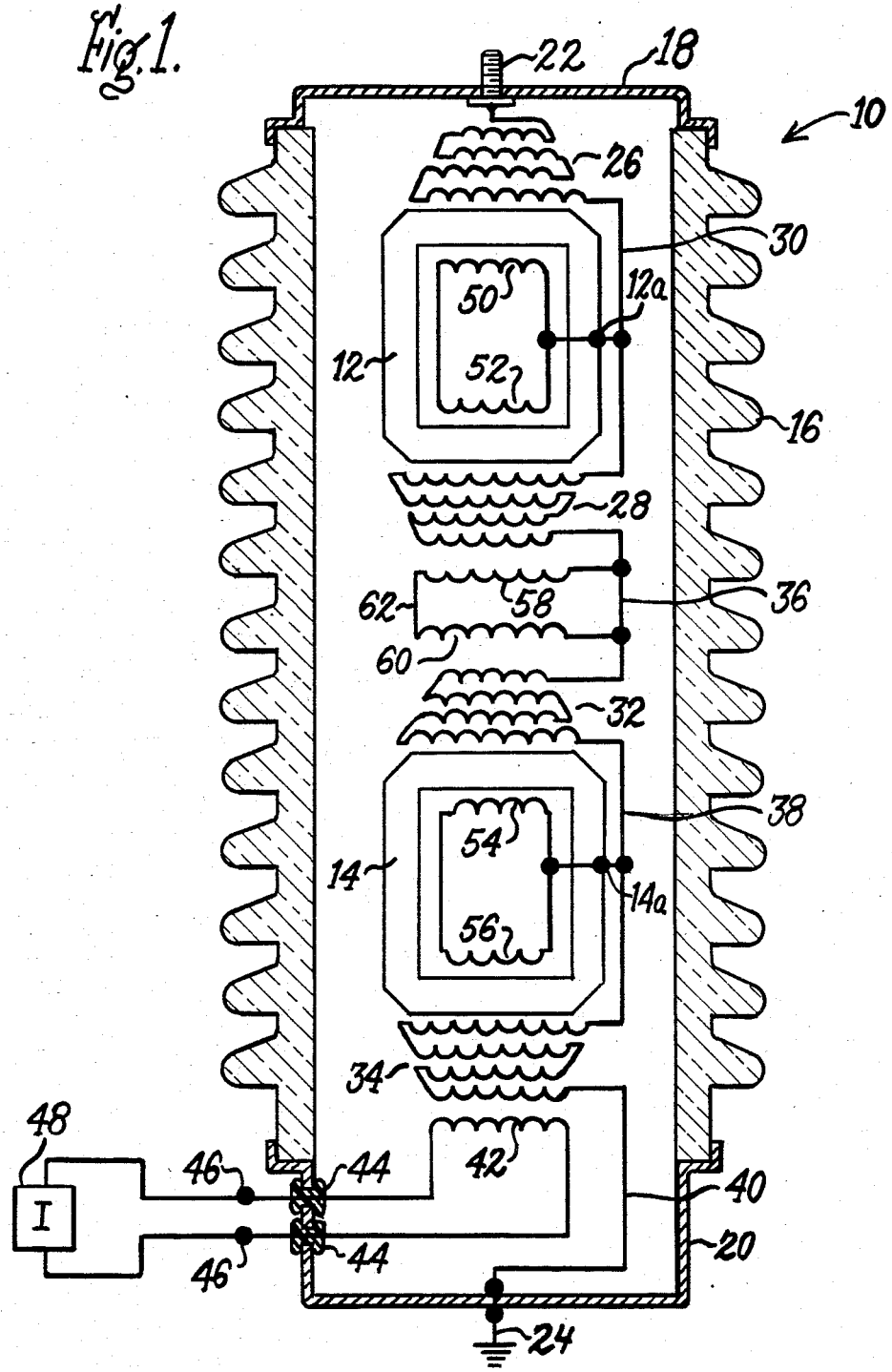
FIG. 1 is a schematic diagram of a cascaded instrument potential transformer of the type to which the present invention is applicable.

A high voltage cascaded instrument potential transformer of the type to which the voltage ratio correction method of the present invention is applicable is generally indicated at 10 in FIG. 1. This transformer includes a pair of cores 12 and 14 each of a rectangular configuration and mounted in vertically spaced relation by suitable support structure (not shown) within a tubular, porcelain housing 16. The upper and lower ends of housing 16 are closed off by metallic end caps 18 and 20, respectively, and the parts contained therein are immersed in a suitable insulating fluid (not shown) rendering the transformer suitable for high voltage applications. Upper end cap 18 is equipped with a high voltage line terminal 22, while the lower end cap 20 is adapted for typical connection to ground potential, as indicated at 24.

Wound about the upper horizontal segment of core 12 is a first multi turn primary winding 26, while a second primary winding 28 is wound about the lower horizontal segment of the same core. These split primary windings are connected in series by a conductor 30, with the upper end of primary winding 26 connected to the high voltage line terminal 22.

Transformer core 14 is similarly wound in split primary winding fashion with primary windings 32 and 34. Primary windings 28 and 32 are connected in series by a conductor 36, and split primary windings 32 and 34 are interconnected by a conductor 38. The other termination of primary winding 34 is connected by a conductor 40 to lower end cap 20 which, as previously indicated, upon typical transformer instllation is grounded, as indicated at 24. It is thus seen that these primary windings ar connected in a series primary winding circuit between high voltage line terminal 22 and lower end cap 20. The winding of these primary windings is carefully controlled such that they all have equal numbers of turns, with the total number of turns in the primary circuit numbering in the tens of thousands.

Still referring to FIG. 1, a secondary winding 42 is wound about the lowerr horizontal segment of core 14, with its terminations brought out through insulative bushings 44 in lower end cap 20 to external terminals 46 suitable for connection with a metering instrument 48 or any other desired low voltage load. An inner coupling winding includes a first coil 50 wound beneath primary winding 26 about the upper horizontal segment of core 12 and second coil 52 wound beneath primary winding 28 about the lower horizontal segment of the same core. These coils are connected in a loop circuit as shown, such that this inner coupling winding circuit is effective in providing tight (low-impedance) coupling between primary windings 26 and 28 on core 12. This inner coupling winding loop circuit and the conductor 30 interconnecting primary windings 26 and 28 are connected together and tied to core 12, as indicated at **12*a* which, assuming equal voltage drops across the four primary windings, sits at three-quarters of the line voltage. Similarly, core 14 is equipped with an inner coupling winding loop circuit consisting of coils 54 and 56. This loop circuit is connected at 14*a* to core 14, as is conductor 38 interconnecting primary windings 32 and 34. The voltage at common connection 14A** resides at one-fourth of the line voltage.

Still referring to FIG. 1, transformer 10 also includes an outer coupling winding which consists of a first coil 58 wound in overlying relation with primary winding 28 on core 12 and a coil 60 wound in overlying relation with primary winding 32 about core 14. The illustrated left terminations of outer coupling winding coils 58 and 60 are connected in common by a conductor 62 spanning the vertical spacing between cores 12 and 14. The right terminations of these coils are separately connected to conductor 36 interconnecting primary windings 28 and 32 and likewise spanning the vertical spacing between cores 12 and 14. As is well understood in the art, this outer coupling winding provides a tight, low impedance coupling between cascaded stages of instrument potential transformer 10.

Figure 2:
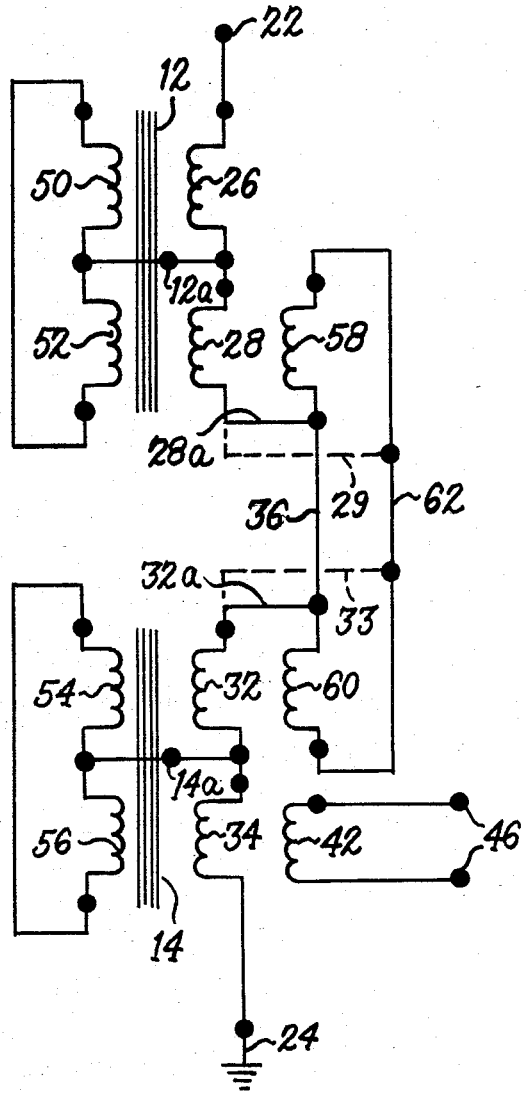
FIG. 2 is a simplified schematic circuit diagram of the transformer of FIG. 1.

The voltage ratio correction method of the present invention will now be described in conjunction with FIG. 2 which is a simplified schematic representation of the instrument transformer of FIG. 1 with corresponding reference numerals used throughout the two figures. Added to FIG. 2 are polarity dots to indicate the relative winding sense of each of the illustrated windings. It will be noted that the solid line representation of the schematic in FIG. 2 corresponds identically to that illustrated in FIG. 1. Specifically, it will be noted that lower termination **28*a* of primary winding 28 and upper termination 32*a* of primary winding 32 are connected in common via interstage spanning conductor 36 in the same manner as illustrated in FIG. 1. As shown by the polarity dots associated with each of the four primary windings, primary current flowing through the series primary circuit between high voltage terminal 22 and ground 24 develops ampere turns in the various primary windings which are in all instances additive. Pursuant to the present invention, if it is found that, upon final testing of an instrument potential transformer conventionally wired in accordance with the schematic of FIG. 1 and the solid line schematic of FIG. 2**, a voltage ratio error exists which falls outside of the tolerance limits established by the American Standards Association Accuracy Parallelogram to which the transformer was designed, adequate voltage ratio correction can, in most instances, be introduced simply by altering the connections of the primary winding circuit with the outer coupling winding loop circuit.

Specifically, if final testing indicates that the voltage developed across terminals 46 connected with secondary winding 42 is too low i.e., is lower than a reference value equal to the applied primary voltage divided by the nameplate turns ratio, termination **32*a* of primary winding 32 is removed from its normal connection with interstage conductor 36 and is connected instead, as indicated by phantom line 33 to interstage spanning conductor 62 of the outer coupling winding loop circuit. Termination 28*a* of primary winding 28 is left in its normal connection with interstage spanning conductor 36. By virtue of this reconnection, it is seen primary circuit current, which previously was shunted from the outer coupling winding coils 58 and 60, now flows in divided fashion through these two coils between primary windings 28 and 32. By virtue of the indicated winding sense polarity dots associated with the primary windings and the outer coupling winding coils, it is seen that the ampere turns of one of these coils is subtracted from the total number of ampere turns developed in the primary windings. Thus, in effect, the total number of primary turns is decreased by the number of turns in one of the outer coupling winding coils, thus changing the primary to secondary winding turns ratio in a manner such as to raise the secondary winding output voltage appearing across terminals 46**.

Conversely, if the secondary output voltage is too high, termination 32*a* of primary winding 32 is left in its solid line indicated connection with conductor 36, and termination 28*a* of primary winding 28 is disconnected from conductor 36 and reconnected, as indicated by phantom line 29, to conductor 62 of the outer coupling winding loop circuit. It is seen from the polarity dot winding sense indications that this modification of the interconnection between the primary circuit and the outer coupling winding loop circuit results in the turns of one of the outer coupling winding coils being added to the total number of primary turns. This adjustment of the transformer turns ratio corrects the secondry voltage across the terminals 46 downward. It has been found that, in most instances of out of tolerance voltage ratio error, the simple addition to or subtraction from the primary circuit turns of the turns of one of the outer coupling winding coils introduces sufficient correction to bring the voltage ratio error within American Standards Association prescribed tolerance limits. It will be appreciated that the introduction of this correction factor pursuant to the present invention, while it does involve draining off the insulating fluid and lifting away the procelain housing, does not require removal of the various windings and core restacking and/or reworking. Consequently, considerable time and expense is saved.

Figure 3:
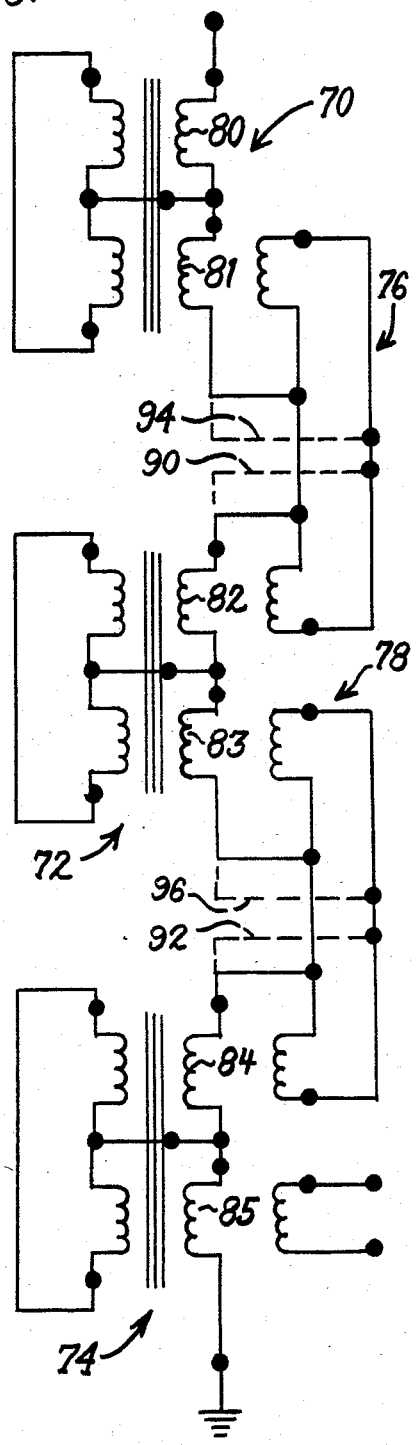
FIG. 3 is a simplified schematic circuit diagram of a cascaded instrument potential transformer of a three core design.

FIG. 3 illustrates that the present invention is equally applicable to an extra high voltage instrument potential transformer including three cascaded transformer core stages, generally indicated at 70, 72 and 74. With three such stages, two outer coupling windings, as generally indicated at 76 and 78, are utilized to achieve tight, low impedance interstage couplings between adjacent stages. The solid line interconnections of the six primary windings 80 through 85 corresponds to the normal wiring convention as subjected to final transformer testing. If an out of tolerance voltage ratio error is found to exist, the reconnections indicated in phantom of the primary circuit with the outer coupling winding circuits are made to either add or subtract the turns of one coil in either one or both of the outer coupling windings. Specifically if it is found necessary to subtract the turns of one outer coupling winding coil from the primary turns, the phantom line connection 90 is made from primary winding 82 to the outer coupling winding loop circuit 76 in lieu of the indicated solid line connection. If a larger voltage ratio correction is required, the phantom line connection 92 is also made from primary winding 84 to outer coupling winding loop circuit 78 in lieu of the illustrated solid line connection. This is seen to additionally subtract the turns of one of the coils of outer coupling winding 78. On the other hand, if final testing indicates that additional primary turns are needed to introduce the requisite correction factor, phantom line connection 94 for primary winding 81 is made to outer coupling winding loop circuit 76 in lieu of the illustrated solid line connection. This adds the turns of one of the coils of outer coupling winding 76 to the primary turns. To additionally add the terms of a second outer coupling winding coil to the primary turns, the phantom line connection 96 is also made to outer coupling winding loop circuit 78 in lieu of the illustrated solid line connection.

From the foregoing description, it is seen that the objects set forth above, including those made apparent from the preceding detailed description, are efficiently attained and, since certain changes may be made and the disclosed method without departing from the scope of the invention, it is intended that all matter contained in the above description and shown in the accompanying drawings shall be interpreted as illustrative and not in a limiting sense.

Having described the invention, what is claimed and as new and desire to secure by Letters Patent is:

1. In an instrument potential transformer of the cascaded type having a plurality of magnetic cores mounted in vertically spaced relation, a primary winding circuit connected in series between high and low voltage transformer terminals and including separate primary windings wound on each said core, an outer coupling winding associated with each adjacent pair of said cores and including a pair of coils connected in a loop circuit with one of said coils wound on one of said cores and the other of said coils wound on the other core of said adjacent core pair, and a secondary winding wound on one of said cores, the method of correcting for inaccuracies in the transformer voltage ratio comprising the steps of:

(a) determining whether the voltage across said secondary winding is higher or lower than a reference value equal to a predetermined voltage applied across said primary winding circuit divided by the desired ratio of said instrument potential transformer, (b) electrically connecting said primary winding circuit into said outer coupling winding loop circuit such as to add the turns of one of said coils to the turns of said primary winding circuit if the voltage developed across said secondary winding is higher than said reference value when said primary winding circuit is energized by said predetermined voltage, and (c) electrically connecting said primary winding circuit into said outer coupling winding loop circuit such as to subtract the turns of one of said coils from the turns of said primary winding circuit if the voltage developed across said secondary winding is lower than said reference value when said primary winding circuit is energized by said predetermined voltage.

2. The voltage ratio correction method as defined in claim 1, wherein said primary winding circuit is normally connected with said outer coupling winding loop circuit such that primary current is shunted from said coils of said outer coupling winding.

3. The voltage ratio correction method as defined in claim 1, wherein said coils of said outer coupling winding are wound on said adjacent core pair in overlying relation with said primary windings.

4. The voltage ratio correction method defined in claim 3, wherein said primary winding circuit includes a split pair of series connected primary windings wound on each said core, and said transformer further includes an inner coupling winding associated with each said core, said inner coupling winding including a pair of coils connected in loop circuit and wound in underlying relation with said primary winding split pair.

5. The voltage ratio correction method defined in claim 1, wherein said electrical connecting steps involve moving the connection of said primary winding circuit with said outer coupling winding loop circuit from one point in said outer coupling winding loop circuit where primary current is shunted from said coils to another point in said outer coupling winding loop circuit where primary current is routed through said coils such as to either add or substract the turns of one of said coils from the total turns of said primary windings in said primary winding circuit.

6. The voltage ratio correction method defined in claim 5, wherein said outer coupling winding loop circuit includes a pair of conductors spanning the vertical spacing between said adjacent core pair, and wherein said primary windings of said adjacent core pair are normally separately connected to one of said conductors, said electrical connecting steps involving disconnecting one of said primary windings from said one conductor and reconnecting said one primary winding to the other conductor of said conductor pair.

7. The voltage ratio correction method of claim 6, wherein said transformer includes two cores.

8. The voltage ratio correction method of claim 1, wherein said transformer includes three vertically spaced cores and two outer coupling winding loop circuits separately electrical connected with said primary winding circuit, said connecting steps comprising changing the electrical connection of said primary winding circuit with one of said outer coupling winding loop circuits to introduce the turns of one outer coupling winding coil into said primary winding circuit or changing the electrical connections of said primary winding circuit with both of said outer coupling winding loop circuits to introduce the turns of two outer coupling winding coils into said primary winding circuit.

9. The voltage ratio correction method of claim 8, wherein the electrical connection change is executed in a manner to either increase or decrease the number of turns in said primary winding circuit by the number of turns in either one or two of said outer coupling winding coils.

* * * * *